US011196209B2

(12) United States Patent
Kim et al.

(10) Patent No.: US 11,196,209 B2
(45) Date of Patent: Dec. 7, 2021

(54) ROUNDED CONNECTOR ASSEMBLY

(71) Applicant: LG Chem, Ltd., Seoul (KR)

(72) Inventors: Sung Gyu Kim, Daejeon (KR); Sang Eun Jung, Daejeon (KR)

(73) Assignee: LG Chem, Ltd.

( * ) Notice: Subject to any disclaimer, the term of this patent is extended or adjusted under 35 U.S.C. 154(b) by 0 days.

(21) Appl. No.: 16/636,071

(22) PCT Filed: Oct. 11, 2018

(86) PCT No.: PCT/KR2018/011986
§ 371 (c)(1),
(2) Date: Feb. 4, 2020

(87) PCT Pub. No.: WO2019/098530
PCT Pub. Date: May 23, 2019

(65) Prior Publication Data

US 2020/0212618 A1 Jul. 2, 2020

(30) Foreign Application Priority Data

Nov. 15, 2017 (KR) ..... 10-2017-0152279

(51) Int. Cl.
*H01R 13/50* (2006.01)
*H01R 13/56* (2006.01)

(52) U.S. Cl.
CPC ..... *H01R 13/50* (2013.01); *H01R 13/562* (2013.01)

(58) Field of Classification Search
CPC ..... H01R 13/50; H01R 13/562; H01R 24/00; H01R 24/60; H01R 24/62
USPC ..... 439/660
See application file for complete search history.

(56) References Cited

U.S. PATENT DOCUMENTS 5,569,882 A * 10/1996 Yokoyama ..... H02G 15/003 174/138 F
5,731,546 A * 3/1998 Miles ..... H01R 9/2416 174/135
7,249,962 B2 * 7/2007 Milette ..... H01R 4/2404 439/404

(Continued)

FOREIGN PATENT DOCUMENTS

CN 105637717 A 6/2016
CN 205790849 U 12/2016

(Continued)

OTHER PUBLICATIONS

Extended European Search Report for Application No. EP18879917.5 dated Jul. 8, 2020, 3 pgs.

(Continued)

*Primary Examiner* — Peter G Leigh
(74) *Attorney, Agent, or Firm* — Lerner, David, Littenberg,Krumholz & Mentlik, LLP

(57) ABSTRACT

A connector assembly with rounded edges, in which an end of a female connector is formed in a round shape and a guide groove having an inner dimension receiving a wire is formed at an end portion to guide the wire to be curved to correspond to the round shape at a wire harness inlet end and guide the curved wire to be received in the guide groove, thereby guiding reduction of tension of the curved wire and prevention of interference with an external structure.

13 Claims, 5 Drawing Sheets

(56) References Cited

U.S. PATENT DOCUMENTS

| | | | | |
|---|---|---|---|---|
| 7,563,985 | B2 * | 7/2009 | Pini | H02G 15/003 174/76 |
| 7,686,660 | B2 | 3/2010 | Chamuel | |
| 9,331,466 | B2 | 5/2016 | Scherpenberg et al. | |
| 2004/0166723 | A1 * | 8/2004 | Kumamoto | H01R 13/5841 439/470 |
| 2004/0185903 | A1 | 9/2004 | Yoshie et al. | |
| 2005/0181660 | A1 | 8/2005 | Milette et al. | |
| 2010/0048061 | A1 | 2/2010 | Helmig et al. | |
| 2010/0105241 | A1 | 4/2010 | Berkobin et al. | |
| 2011/0136383 | A1 | 6/2011 | Ohta | |
| 2016/0254614 | A1 | 9/2016 | Matsumura | |

FOREIGN PATENT DOCUMENTS

| | | | | |
|---|---|---|---|---|
| JP | H01100877 | A | 4/1989 | |
| JP | 2000299162 | * | 10/2000 | H01R 13/56 |
| JP | 2000299162 | A | 10/2000 | |
| JP | 2000353558 | A | 12/2000 | |
| JP | 2001297821 | * | 10/2001 | H01R 13/56 |
| JP | 2001297821 | A | 10/2001 | |
| JP | 2004253272 | A | 9/2004 | |
| JP | 2004289320 | A | 10/2004 | |
| JP | 2010510634 | A | 4/2010 | |
| JP | 2011239619 | A | 11/2011 | |
| JP | 2016046108 | * | 4/2016 | H01R 13/59 |
| JP | 2016046108 | A | 4/2016 | |
| JP | 2016091677 | A | 5/2016 | |
| JP | 2016100123 | A | 5/2016 | |
| JP | 2016201235 | A | 12/2016 | |
| KR | 20100010356 | U | 10/2010 | |
| KR | 20110053971 | A | 5/2011 | |

OTHER PUBLICATIONS

International Search Report for Application PCT/KR2018/011986 dated Jan. 31, 2019.

Chinese Search Report for Application No. 201880047138.3, dated Oct. 12, 2020, pp. 1-2.

* cited by examiner

PRIOR ART
[Figure 1]
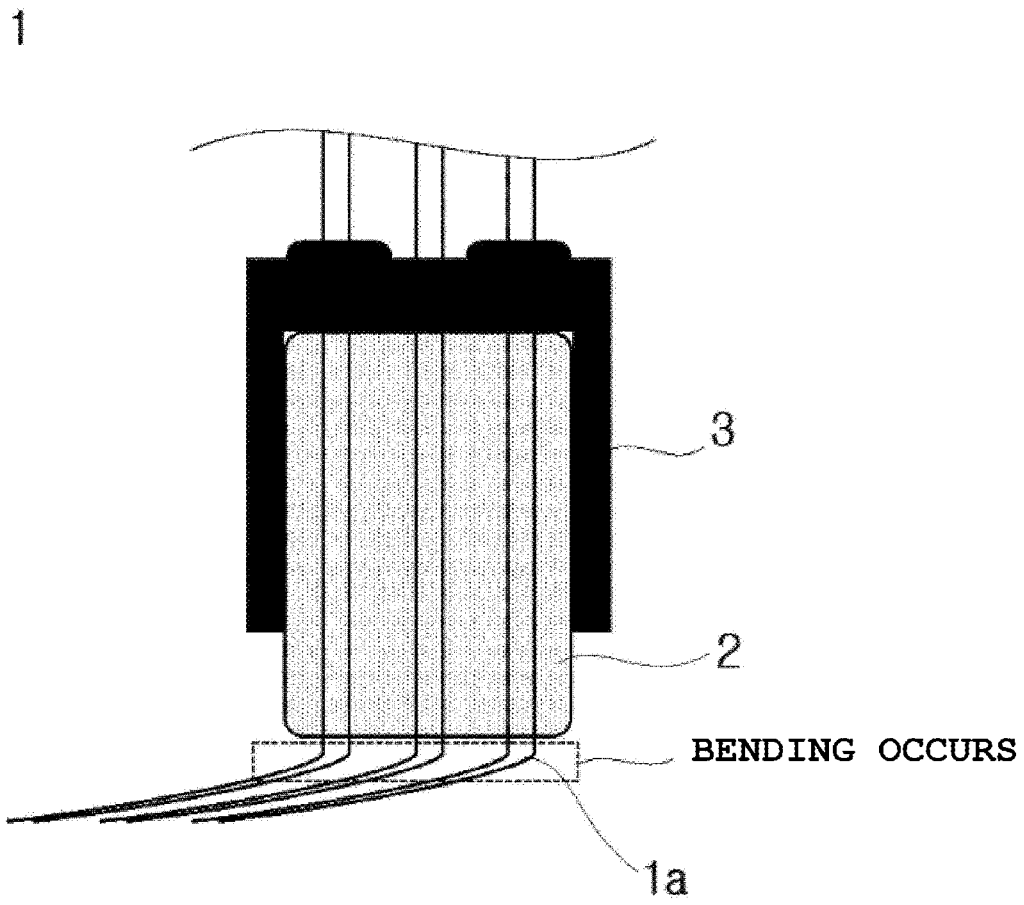

[Figure 2]
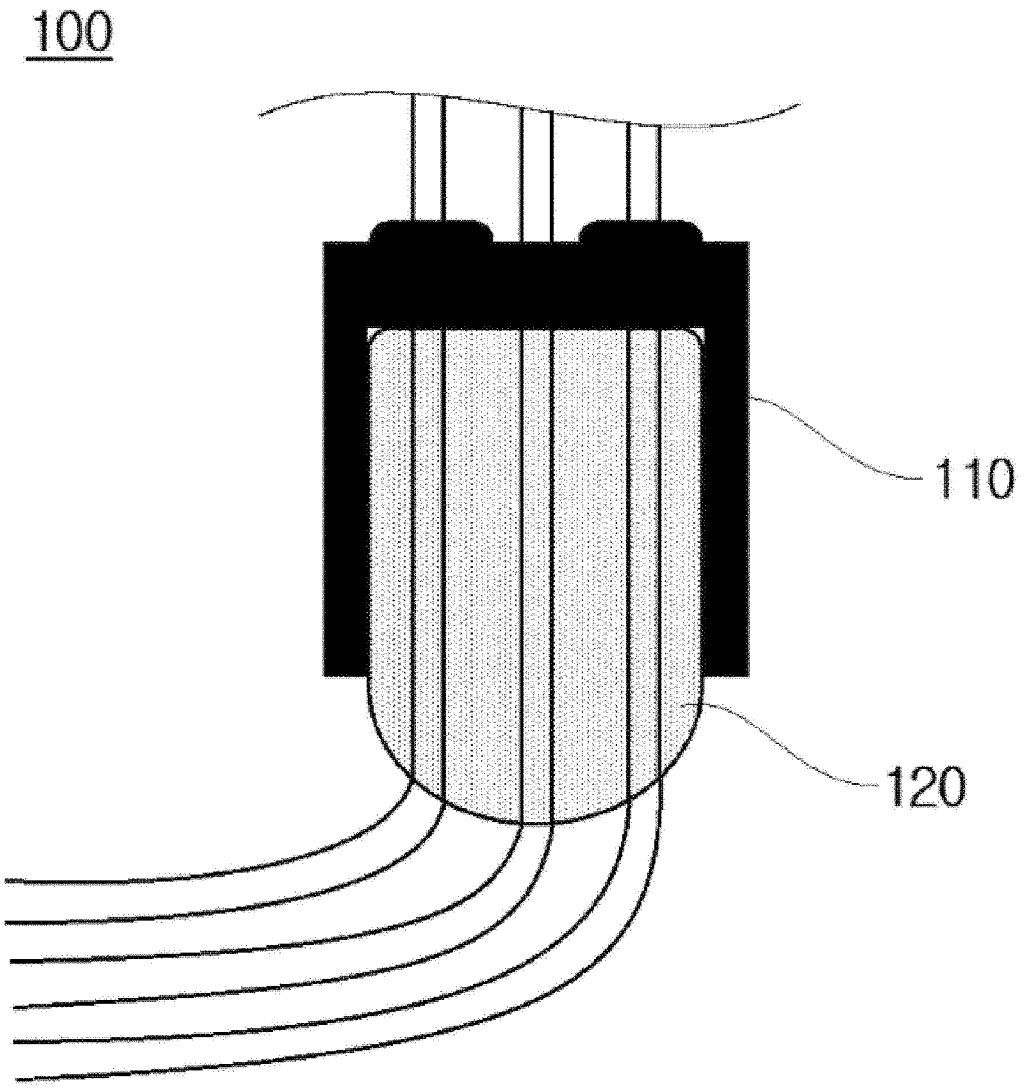

[Figure 3]
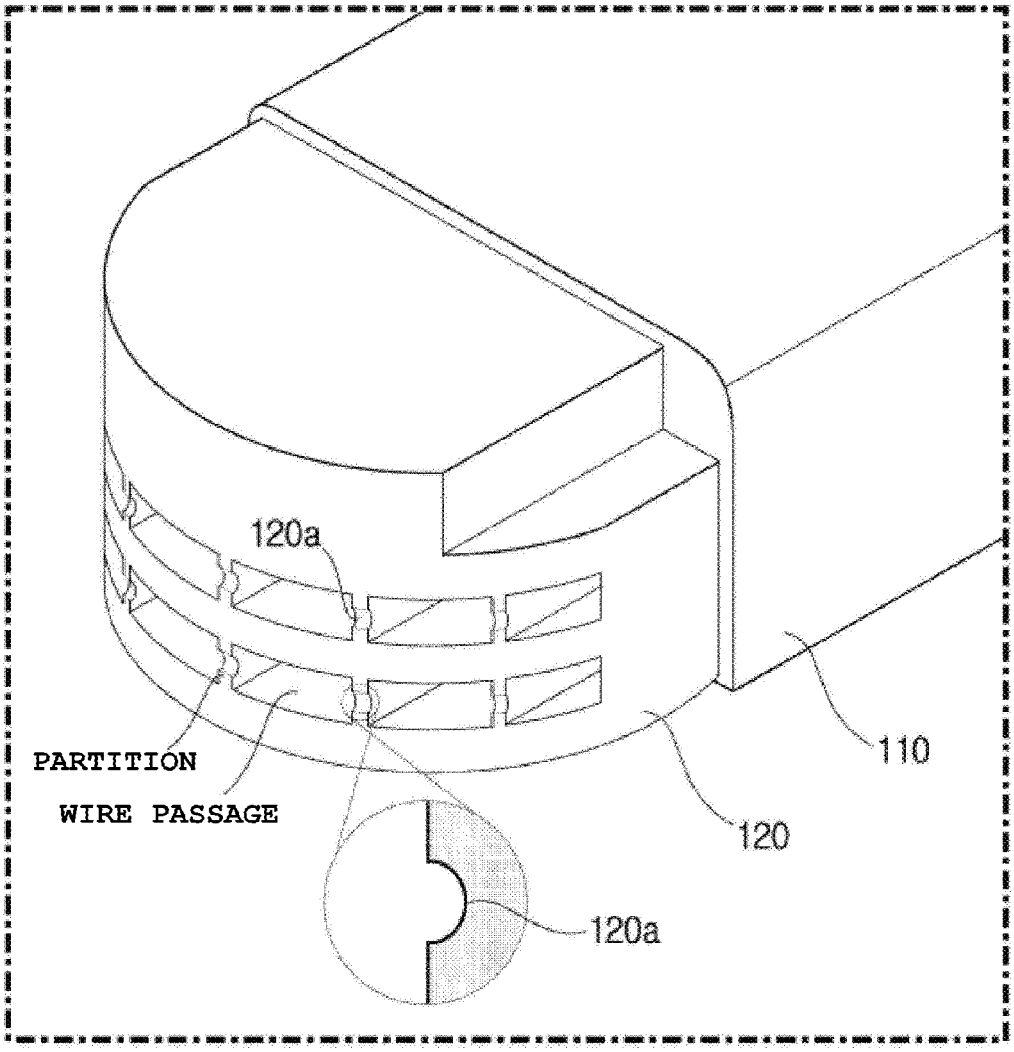

[Figure 4a]
PRIOR ART
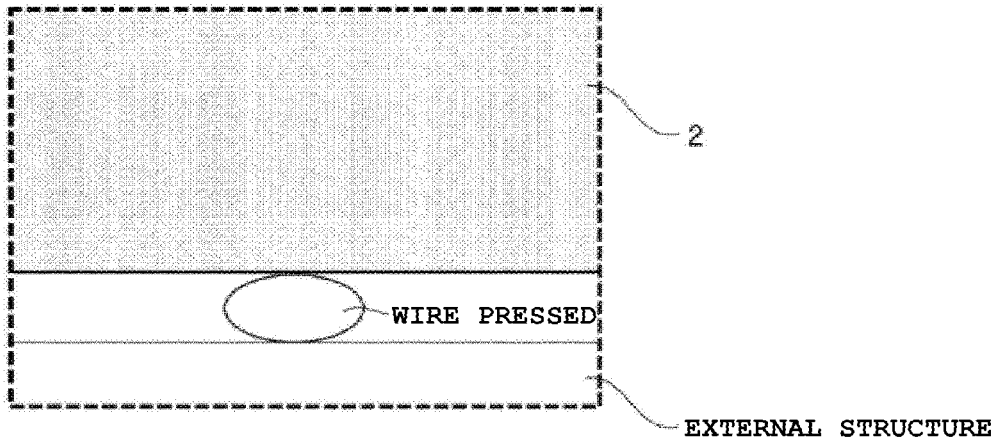

[Figure 4b]
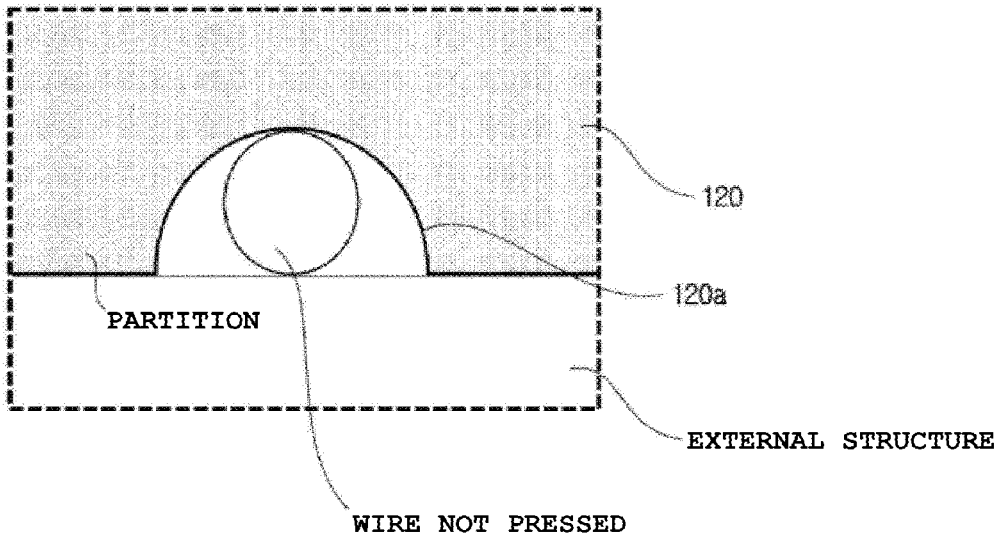

ROUNDED CONNECTOR ASSEMBLY

CROSS-REFERENCE TO RELATED APPLICATIONS

The present application is a national phase entry under 35 U.S.C. § 371 of International Application No. PCT/KR2018/011986 filed Oct. 11, 2018, published in Korean, which claims priority from Korean Patent Application No. 10-2017-0152279 filed Nov. 15, 2017, all of which are incorporated herein by reference.

TECHNICAL FIELD

The present invention relates to a female connector with rounded edges, and more particularly, to a connector assembly with rounded edges, in which an end of a female connector is formed in a round shape and a guide groove having an inner dimension receiving a wire is formed at an end portion to guide the wire to be curved to correspond to the round shape at a wire harness inlet end and guide the curved wire to be received in the guide groove, thereby guiding reduction of tension of the curved wire and prevention of interference with an external structure.

BACKGROUND ART

In general, in the case of most connector assemblies in which a male connector and a female connector are coupled to each other, an end corner portion of the female connector is formed in a rectangular structure and in this case, a wire harness inlet is flat, and as a result, when bending occurs due to a structural characteristic, a wire is suddenly bent and tilted to a lateral side of a connected terminal, which may cause a contact failure of a connector.

In the related art, in order to solve such a problem, a predetermined inclined surface is formed at the wire harness inlet to apply a structure to contact the wire with the inclined surface, but in this case, an edge of the inclined surface is not still gentle, but has a pointed structure, and as a result, it is difficult to solve the problem in that the wire is suddenly bent.

Therefore, in order to solve the problem and a limitation which occur at the wire harness inlet end of the connector in the related art, the present inventor has developed a connector assembly with rounded edges, in which an end of a female connector fastened to a male connector is formed in a round shape and a wire is guided to be curved to correspond to the round shape at a wire harness inlet end to reduce tension applied to the wire, thereby preventing a contact failure and a disconnection failure.

SUMMARY

The present invention relates to a female connector with rounded edges, and more particularly, to a connector assembly with rounded edges, in which an end of a female connector is formed in a round shape and a guide groove having an inner dimension receiving a wire is formed at an end portion to guide the wire to be curved to correspond to the round shape at a wire harness inlet end and guide the curved wire to be received in the guide groove, thereby guiding reduction of tension of the curved wire and prevention of interference with an external structure.

According to an embodiment of the present invention, a connector assembly with rounded edges includes: a first connector; and a second connector having a first side that is coupled to the first connector, and a second side having an end portion that is formed in a round shape, in which the second connector is adapted to receive one or more wires which extend outwards from the end portion of the second connector at a curve that corresponds to the round shape.

In an embodiment, the end portion of the second connector may be symmetrical across a longitudinal direction extending from the first side to the second side.

In an embodiment, the first connector and the second connector may be coupled to each other by forcible fitting.

In an embodiment, the second connector may include a plurality of wire passages extending in the longitudinal direction through the second connector, in which the wire passages are partitioned by partitions, and a guide groove formed at end portions of the partitions, in which the guide groove may be dented so as to receive a lateral surface of the one or more wires extending outwards from the end portion of the second connector at a curve that corresponds to the round shape of the second connector.

In an embodiment, the guide groove may be adapted to have a shape that corresponds to the lateral surface of the one or more wires, and may have an internal space adapted to fully receive the lateral surface of the one or more wire. The one or more wires being positioned in the internal space may avoid interference between an external structure and the lateral surface of the one or more wires.

Advantageous Effects

According to an aspect of the present invention, it is advantageous in that a connector assembly with rounded edges, in which an end of a female connector fastened to a mal connector is formed in a round shape and a wire is guided to be curved to correspond to the round shape at a wire harness inlet end to reduce tension applied to the wire, thereby preventing a contact failure and a disconnection failure.

In particular, according to an aspect of the present invention, it is advantageous in that as a guide groove is formed at an end portion of a female connector so that the curved wire is curved in a longitudinal direction, even though the wire is curved according to the round shape of the female connector by an external structure, the wire is received in the guide groove, and as a result, interference with the external structure does not occur.

BRIEF DESCRIPTION OF DRAWINGS

FIG. 1 is a diagram schematically illustrating a shape of a conventional connector assembly 1 with a female connector 2 having a rectangular-structure female connector 2 in which an inlet of wire harness is flat.

FIG. 2 is a diagram schematically illustrating a shape of a connector assembly 100 with rounded edges according to an embodiment of the present invention.

FIG. 3 is a diagram more specifically illustrating a guide groove 120*a* illustrated in FIG. 2.

FIG. 4 is a diagram illustrating a state in which a wire is pressed by a female connector 2 and an external structure in the related art and a state in which interference of the wire is avoided by the guide groove 120*a* illustrated in FIG. 3 and the external structure.

DETAILED DESCRIPTION

Hereinafter, a preferred embodiment is presented in order to assist understanding of the present invention. However, the following embodiment is just provided to more easily understand the present invention and contents of the present invention are not limited by the embodiment.

FIG. 1 is a diagram schematically illustrating a shape of a connector assembly 1 with a female connector 2 having a rectangular-structure female connector 2 in which an inlet of wire harness is flat.

Referring to FIG. 1, in a general connector assembly 1, a female connector 2 and a male connector 3 having a rectangular structure, in which an inlet of wire harness is flat are fitted and coupled to each other.

In this case, since an end of the female connector 2 is flat, when a wire 1*a* of the connector assembly 1 is disposed in a structure in which the wire 1*a* is bent, the wire 1*a* is suddenly bent by the end of the female connector 2. In this case, while tension of a bent portion of the wire 1*a* suddenly increases, damage to the wire is caused and the wire 1*a* is suddenly tilted to a lateral side of a terminal, which causes contact failure of the connector assembly 1.

Accordingly, in the present invention, a technique capable of minimizing a sudden bending phenomenon of the wire 1*a* will be described with reference to FIG. 2.

FIG. 2 is a diagram schematically illustrating a shape of a connector assembly 100 with rounded edges according to an embodiment of the present invention.

Referring to FIG. 2, the connector assembly 100 with the rounded edges according to an embodiment of the present invention may be configured to generally include a first connector 110 and a second connector 120 of which one side is coupled to the first connector.

Here, the first connector 110 may mean a male connector having a general shape and the second connector 120 may mean the female connector. Further, the first and second connectors 110 and 120 may be fastened through forcible fitting and coupling to each other.

In this case, the second connector 120 may be formed in a round shape in which the end (more specifically, an end portion in which the wire harness is formed) is not formed to be flat, but laterally symmetric based on a center portion.

More specifically, the end of the second connector 120 protrudes outwards and a corner portion is formed in a rounded gentle curve shape, and as a result, one or more wires which extend to the outside of the second connector 120 may be curved according to the round shape of the second connector 120.

For example, even in a structure in which the connector assembly 100 with the rounded edges is disposed to be bent to left and right sides, one or more wires are slowly bent according to a round shape having a gentle curve shape, and as a result, the tension applied to the wire is suddenly reduced.

Accordingly, through the structure of the present invention, even in a structure in which the connector assembly is disposed to be bent, the sudden bending phenomenon and tension increase of the wire may be prevented and the resulting contact failure and disconnection failure, the contact failure of the connector assembly, etc., may be prevented.

In this case, a guide groove 120*a* may be formed at the end portion of the second connector 120, which prevents the wire which is slowly curved in the curve shape from being pressed between the external structures. This will be described in more detail with reference to FIGS. 3 and 4.

FIG. 3 is a diagram more specifically illustrating a guide groove 120*a* illustrated in FIG. 2.

Referring to FIG. 3, as the end portion of the second connector 120 is formed to have a round shape in which left and right sides are symmetric to each other, even though the second connector 120 itself moves laterally, the sudden bending phenomenon and the tension increase of the wires which come outside through multiple wire passages formed to penetrate in the longitudinal direction of the second connector 120 may be prevented.

In this case, the guide groove 120*a* which is dented inside is formed at end portions of partitions partitioning multiple wire passages from each other so as to receive a lateral surface of the wire which comes outside through multiple wire passages.

The guide groove 120*a* may be formed at each of all of ends of respective partitions and the size of the guide groove 120*a* is formed to have an internal space having a size to fully receive the lateral surface of the wire.

Accordingly, even though the wire is curved due to interference with the external structure, the wire is received in the guide groove 120*a*, and as a result, interference between the external structure and the lateral surface of the wire is avoided, thereby avoiding damage and cutting of the wire. This will be described in more detail with reference to FIG. 4.

FIG. 4 is a diagram illustrating a state in which a wire is pressed by a male connector 3 and an external structure in the related art and a state in which interference of the wire is avoided by the guide groove 120*a* illustrated in FIG. 3 and the external structure.

First, referring to FIG. 4(*a*), FIG. 4(*a*) is a diagram illustrating a state in which a wire (corresponding to a cross section in the figure) interposed between an outer surface of the female connector 2 and the outer surface of the external structure is pressed when the female connector 2 in the related art, in which the end corresponds to a flat shape and the external structure (e.g., printed circuit board (PCB), etc.) are positioned adjacent to each other.

In this case, since the female connector 2 has no structure for preventing the wire from being pressed, there is a problem in that the interference cannot but occur while the wire is pressed.

On the contrary, FIG. 4(*b*) is a diagram illustrating a state in which the wire is not pressed as the wire (corresponding to the cross section in the figure) is received in the guide groove 120*a* formed on the partition of the second connector 120 when the second connector 120 and the external structure illustrated in FIG. 3 are positioned adjacent to each other.

In this case, as the wire is fully received in the guide groove 120*a*, there is no interference between the wire and the external structure, thereby preventing the damage, cutting, etc., of the wire.

The present invention has been described with reference to the preferred embodiments of the present invention, but those skilled in the art will understand that the present invention can be variously modified and changed without departing from the spirit and the scope of the present invention which are defined in the appended claims.

The invention claimed is:

1. A connector assembly, comprising:

a first connector;

a second connector having a first end that is coupled to the first connector, and a second end having a convex outer surface, wherein the second connector is adapted to receive one or more wires which extend outwards from an opening in the convex outer surface of the second end at a curve that corresponds to the convex outer surface.

2. The connector assembly of claim 1, wherein the second end of the second connector is symmetrical across a longitudinal direction extending from the first end to the second end.

3. The connector assembly of claim 1, wherein the first connector and the second connector are coupled to each other by forcible fitting.

4. The connector assembly of claim 1, wherein the second connector includes:

a plurality of wire passages extending in the longitudinal direction through the second connector, wherein the wire passages are partitioned by partitions; and a guide groove formed at each end of the partitions, wherein the guide groove is dented so as to receive a lateral surface of the one or more wires extending outwards from openings in the convex outer surface at a curve that corresponds to the convex outer surface.

5. The connector assembly of claim 4, wherein the guide groove is adapted to have a shape that corresponds to the lateral surface of the one or more wires, and to have an internal space adapted to fully receive the lateral surface of the one or more wires, wherein the one or more wires being positioned in the internal space avoids interference between an external structure and the lateral surface of the one or more wires.

6. The connector assembly of claim 1, wherein the second end of the second connector is symmetrical across a longitudinal direction extending from the first end to the second end.

7. The connector assembly of claim 1, wherein the first connector and the second connector are coupled to each other by forcible fitting.

8. The connector assembly of claim 1, wherein the second connector includes:

a plurality of wire passages extending in the longitudinal direction through the second connector, wherein the wire passages are partitioned by partitions, wherein the guide groove is formed at the outer surface of the second end in the partitions between the wire passages.

9. The connector assembly of claim 8, wherein the guide groove is adapted to have a shape that corresponds to the lateral surface of the one or more wires, and to have an internal space adapted to fully receive the lateral surface of the one or more wires, wherein the one or more wires being positioned in the internal space avoids interference between an external structure and the lateral surface of the one or more wires.

10. The connector assembly of claim 1, further comprising a guide groove extending lengthwise along the convex outer surface of the second end, wherein the guide groove forms a space that is adapted to receive at least one of the one or more wires which extend outwards from the opening of the convex outer surface.

11. The connector assembly of claim 10, wherein the guide groove has a depth adapted to avoid interference between an external structure and a lateral surface of a wire extending lengthwise through the guide groove along the convex outer surface of the second end.

12. A connector assembly, comprising:

a first connector; and a second connector having a first end that is coupled to the first connector, and a second end having an outer surface that is formed in a rounded shape, wherein the second connector is adapted to receive one or more wires which extend outwards from the second end at a curve that corresponds to the rounded shape; and a guide groove formed in the outer surface of the second end and extending lengthwise along the outer surface of the second end, wherein the guide groove is dented so as to receive a lateral surface of one or more wires extending outwards from the second end of the second connector.

13. The connector assembly of claim 12, wherein the guide groove has a depth adapted to avoid interference between an external structure and a lateral surface of a wire extending lengthwise through the guide groove along the outer surface of the second end.

* * * * *